US010995565B1

(12) United States Patent
Babich et al.

(10) Patent No.: US 10,995,565 B1
(45) Date of Patent: May 4, 2021

(54) TUBULAR HANDLING TOOL

(71) Applicant: Logan Industries International Corporation, Hempstead, TX (US)

(72) Inventors: Shayne Edward Babich, Magnolia, TX (US); Nathan Ernest Barber, Tomball, TX (US); James Bradford Riley, Houston, TX (US)

(73) Assignee: Logan Industries International Corporation, Hempstead, TX (US)

( * ) Notice: Subject to any disclaimer, the term of this patent is extended or adjusted under 35 U.S.C. 154(b) by 0 days.

(21) Appl. No.: 16/718,980

(22) Filed: Dec. 18, 2019

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/15; E21B 19/14
USPC ..... 414/22.51–22.71
See application file for complete search history.

(56) References Cited

U.S. PATENT DOCUMENTS 3,958,493 A * 5/1976 Fujita ..... F15B 11/123 91/525
4,852,464 A * 8/1989 Bartmann ..... F15B 15/16 92/53
5,249,502 A * 10/1993 Radocaj ..... F15B 15/1409 91/173
6,155,776 A * 12/2000 Moyna ..... B60P 1/006 414/513
10,081,990 B2 * 9/2018 Meuth ..... B65G 27/08
10,151,157 B2 * 12/2018 Guerra ..... E21B 19/15
2004/0208738 A1 * 10/2004 Morelli ..... E21B 19/155 414/745.8
2006/0285941 A1 * 12/2006 Fikowski ..... E21B 19/155 414/22.54
2009/0308243 A1 * 12/2009 Tillaart ..... F15B 15/16 92/171.1
2012/0130537 A1 * 5/2012 Gerber ..... E21B 19/15 700/244
2013/0340572 A1 * 12/2013 Flusche ..... E21B 19/16 81/57.4
2015/0139773 A1 * 5/2015 Nikiforuk ..... B65G 15/24 414/814
2017/0328146 A1 * 11/2017 Meuth ..... E21B 19/15

* cited by examiner

*Primary Examiner* — Lynn E Schwenning
(74) *Attorney, Agent, or Firm* — Daniel N. Lundeen; Lundeen & Lundeen PLLC

(57) ABSTRACT

Pipe-handling tool for use in a drilling rig catwalk. A V-shaped pipe kicker plate is mounted in a pipe trough and has a pinned end mounted for rotation about the pin and a free end. An actuator has an extendable rod end attached to the kicker plate. The extendable rod has telescopically engaged first and second stages. An annular first stage piston is slidably disposed to engage a drive end of the first stage of the rod. A first stage gland slidably receives the first stage of the rod. A second stage piston is slidably disposed within the first stage piston to engage a drive end of the second stage of the rod. The first stage can have a longer stroke than the first stage, whereas the second stage can have a higher stroke velocity to assist kicking the pipe from the trough.

23 Claims, 8 Drawing Sheets

TUBULAR HANDLING TOOL

CROSS REFERENCE TO RELATED APPLICATION

None.

FIELD OF THE INVENTION

This application is directed to a tubular handling trough having an actuated pipe kicker used in the handling of drilling tubulars in a catwalk of a drilling rig.

BACKGROUND

A catwalk pipe-handling tool is available under the trade designation Pipe Wrangler™ from Forum Energy Technologies. In operation, a tubular is placed in a V-shaped pipe trough in a platform. The tubular must then be ejected to make room for the next tubular to take its place in the pipe trough. This is accomplished by a set of V-shaped kicker plates in the bottom of the pipe trough. These kicker plates are pinned at one end and have a hydraulic cylinder pinned near the middle of the kicker plates. When the hydraulic cylinders extend, the kicker plates rotate about the pin at the end, lifting the tubular out of the pipe trough 14 and rolling it across the platform. When the tubular is fully ejected from the pipe trough, the hydraulic cylinders retract and the process repeats with another tubular. This process can take place many times per day.

With the existing equipment, however, the cylinder has a limited stroke, and a tubular sometimes fails to be fully ejected from the pipe trough and/or rolled across the platform. When this occurs, a costly manual intervention must occur. In the existing devices, the location of the cylinder limits the outside dimensional envelope of the cylinder, and the mounting provisions and attachments to kicker plate and pipe kicker assembly are designed around the existing cylinder. With hundreds of machines in existence of the same design, it would be costly to redesign and manufacture mating components to match a dimensionally different cylinder.

What is needed is a more reliable kicker actuation. Ideally, a design using the existing pipe handling tool and hydraulic cylinder dimensions would facilitate a simple retrofit.

SUMMARY OF THE INVENTION

Applicant has found that a two-stage hydraulic cylinder, having the same profile as the existing hydraulic cylinders used to actuate the pipe kicker in the catwalk pipe handling tool, can provide a longer extension and a faster end-of-stroke extension speed, leading to improved pipe ejection reliability. The cylinder has the same profile and exterior dimensions as the existing cylinders, facilitating retrofit.

In some embodiments of the invention, a pipe-handling tool for use in a catwalk of a drilling rig comprises: a pipe trough; a V-shaped pipe kicker plate mounted in the pipe trough; the kicker plate comprising a pinned end mounted for rotation about the pin and a free end; an actuator comprising a fixed end attached to a mounting point below the kicker plate and an extendable rod end attached to the kicker plate between the pinned end and the free end; the extendable rod comprising telescopically engaged first and second stages; an annular first stage piston slidably disposed within a housing of the actuator to engage a drive end of the first stage of the rod; a first stage gland disposed at a distal end within the housing and slidably receiving the first stage of the rod; a second stage piston slidably disposed within the first stage piston to engage a drive end of the second stage of the rod; a second stage gland disposed at a distal end within the first stage rod and slidably receiving the second stage of the rod; and a source of pressurized fluid to expand a chamber defined by the housing and the first and second stage pistons.

In other embodiments of the invention, an actuated kicker plate assembly is provided for use with a pipe-handling tool in a catwalk of a drilling rig, The assembly comprises a V-shaped pipe kicker plate for mounting in the pipe trough with a pinned end mounted for rotation about the pin and a free end, and an actuator comprising a fixed end for attachment to a mounting point below the kicker plate and an extendable rod end attached to the kicker plate between the pinned end and the free end. The extendable rod comprises telescopically engaged first and second stages. An annular first stage piston is slidably disposed within a housing of the actuator to engage a drive end of the first stage of the rod. A first stage gland slidably receives the first stage of the rod and is disposed at a distal end of a first stage annulus between the housing and the first stage of the rod. A second stage piston is slidably disposed within the first stage piston to engage a drive end of the second stage of the rod. A second stage gland slidably receives the second stage of the rod and is disposed at a distal end of a second stage annulus between the first stage rod and the second stage rod A source of hydraulic fluid is provided to expand a chamber defined by the housing and the first and second stage pistons.

In further embodiments, the invention provides a method of handling pipe using the pipe-handling tool described herein, comprising: placing a tubular in the pipe trough; supplying the pressurized fluid to expand the chamber and extend the first stage of the rod without extending the second stage of the rod; and then supplying additional pressurized fluid to further expand the chamber and extend the second stage of the rod; whereby the kicker plate is rotated about the pin and the tubular is ejected from the pipe trough.

BRIEF DESCRIPTION OF THE DRAWINGS

The attached drawings herein include the following figures.

DETAILED DESCRIPTION

Figure 1:
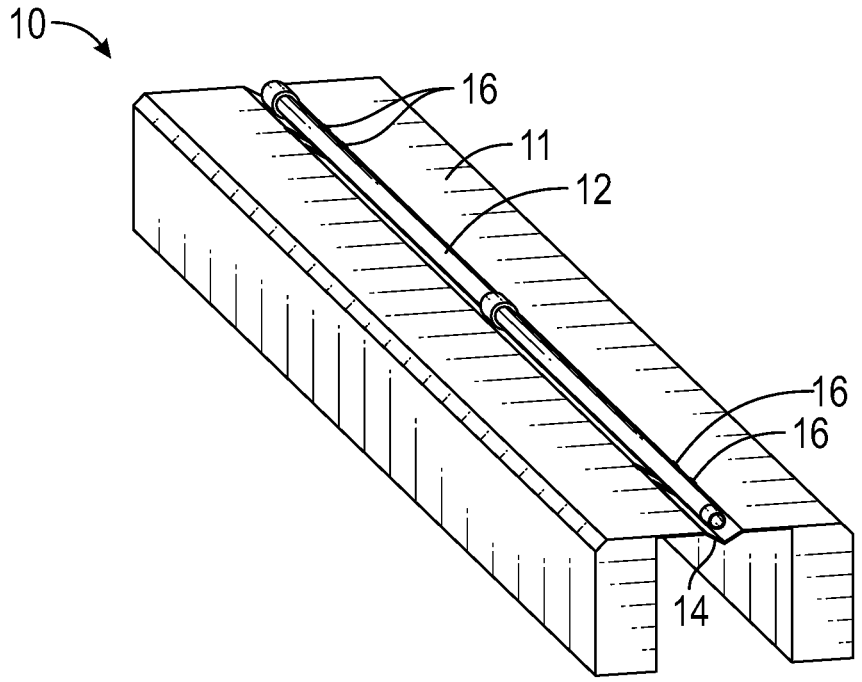
FIG. 1 is a perspective view of a catwalk pipe handling tool receiving a tubular according to an embodiment of the present invention.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data. All numerical values within the detailed description and the claims herein are modified by "about" or "approximately" the indicated value, and take into account experimental error and variations that would be expected by a person having ordinary skill in the art.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. Any device or method or system described herein can be comprised of, can consist of, or can consist essentially of any one or more of the described elements.

Catwalk: A long, rectangular platform located perpendicular to the vee-door of a drilling rig at the bottom of the slide used as a staging area for rig and drillstring tools, components that are about to be picked up and run, or components that have been run and are being laid down; the functionally similar staging area, especially on offshore drilling rigs, that may not be a separate or raised structure.

Clevis: a U-shaped piece that has holes in the prongs to accept a pin.

Double-acting cylinder: a cylinder having pistons that can be pushed from both sides alternately.

Gland: a general type of stuffing box, used to seal a rotating or reciprocating shaft against a fluid; a structure in the stuffing box supporting the seal.

Hydraulic fluid: a liquid medium used in the operation of hydraulic equipment.

Kicker plate: a structure that pushes against (something) to cause sudden movement.

Piston: a disk or short cylinder fitting closely within a tube in which it moves up and down against a liquid or gas Rod: a straight bar.

Seal: a mechanical device that helps join systems or mechanisms together by preventing leakage, containing pressure, or excluding contamination.

Trough: a long, narrow, open container.

Tubular: any type of oilfield pipe, such as drill pipe, drill collars, pup joints, casing, production tubing, pipeline, etc.

According to embodiments of the present invention, a pipe-handling tool is provided for use in a catwalk of a drilling rig. The tool comprises a pipe trough, a V-shaped pipe kicker plate mounted in the pipe trough, and an actuator for the kicker plate. The kicker plate comprises a pinned end mounted for rotation about the pin and a free end.

The actuator comprises a fixed end attached to a mounting point below the kicker plate and an extendable rod end attached to the kicker plate between the pinned end and the free end. The extendable rod comprises telescopically engaged first and second stages. An annular first stage piston is slidably disposed within a housing of the actuator to engage a drive end of the first stage of the rod. A first stage gland slidably receives the first stage of the rod and is disposed at a distal end of a first stage annulus between the housing and the first stage of the rod. A second stage piston is slidably disposed within the first stage piston to engage a drive end of the second stage of the rod. A second stage gland slidably receives the second stage of the rod and is disposed at a distal end of a second stage annulus between the first stage rod and the second stage rod. A source of pressurized fluid is provided to expand a chamber defined by the housing and the first and second stage pistons.

In any embodiment, the pipe handling tool can further comprise a plurality of the V-shaped pipe kicker plates spaced apart along the pipe trough and a like plurality of respective pins and actuators, wherein the respective pins are coaxial. For example, the kicker plate assemblies can be provided in pairs adjacent opposite ends of the trough, to provide redundancy at either end.

Preferably, a lateral area of the first stage piston communicating with the chamber is larger than a lateral area of the second stage piston communicating with the chamber, whereby initially introducing the pressurized fluid into the chamber initially extends the first stage rod. Also, displacement of the second stage rod per given volume of chamber expansion can be greater than displacement of the first stage rod, whereby extension of the second stage of the rod is faster than extension of the first stage of the rod at the same rate of supply of the pressurized fluid.

In any embodiment, the pressurized fluid preferably comprises hydraulic fluid, but could be a gas if desired.

In any embodiment, the first stage annulus can be ported through the housing, and the first annulus and the second stage annulus can be cross-ported.

In any embodiment, the housing can comprise a cylindrical barrel, a head cap at a distal end of the barrel, and a butt plate at a proximal end of the barrel.

In any embodiment, the first stage piston can be annular and comprise a sleeve portion having an inside diameter engaging (preferably threadedly engaging) an outside diameter of the first stage rod, and a flange portion extending inwardly to provide a stop for the second stage piston. Preferably, a first piston seal is carried on an outside diameter of the first stage piston and is biased against an inside diameter of the cylinder. The sleeve portion of the first piston can provide a first shoulder to stop extension of the first rod when the first shoulder abuts the head cap.

In any embodiment, the second stage piston can be cylindrical and engage (preferably threadedly engage) a proximal end of the second stage rod. Preferably, a second piston seal is carried on an outside diameter of the second stage piston and biased against an inside diameter of the first stage rod. The second stage gland can be carried on an inside diameter at a distal end of the first stage rod, and the second stage piston can provide a second shoulder to stop extension of the second rod when the second shoulder abuts the second stage gland.

The present invention also provides the actuated kicker plate assembly for use with the pipe-handling tool in the catwalk of a drilling rig.

The present invention also provides a method of handling pipe using the pipe-handling tool described herein. The method comprises the steps of: placing a tubular in the pipe trough; supplying the pressurized fluid to expand the chamber and extend the first stage of the rod without extending the second stage of the rod; and then supplying additional pressurized fluid to further expand the chamber and extend the second stage or the rod; whereby the kicker plate is rotated about the pin and the tubular is ejected from the pipe trough. In this method, the second stage of the rod can preferably be extended at a faster rate than the first stage of the rod is extended.

Figure 2:
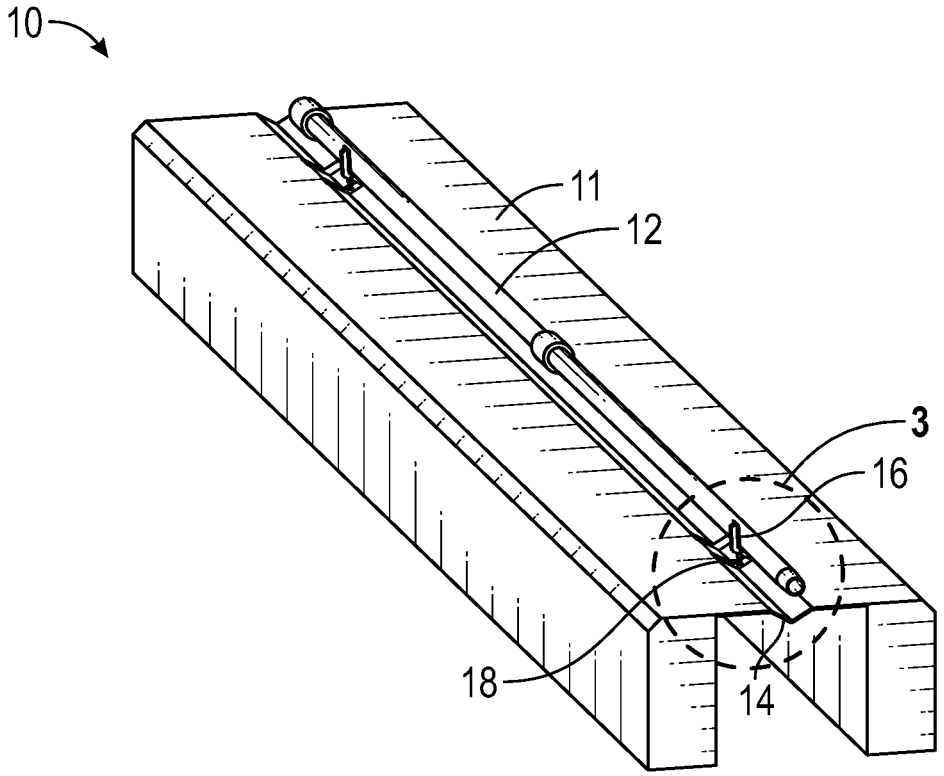
FIG. 2 is a perspective view of the tool of FIG. 1 in which the pipe kicker is actuated fir ejection of the tubular.
Figure 3:
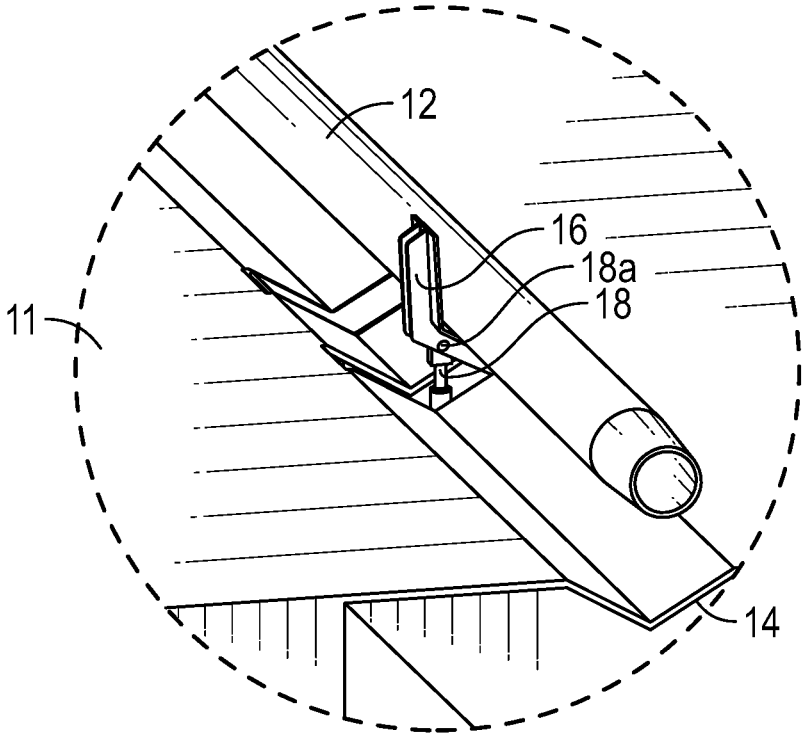
FIG. 3 is an enlarged view of detail 3 shown in FIG. 2.

With reference to the drawing figures wherein like reference numerals refer to like parts, FIGS. 1-3 show a catwalk pipe handling tool 10 receiving a tubular 12 according to an embodiment of the present invention. In operation, a tubular 12 is placed in a V-shaped pipe trough 14 in a platform 11. When it is desired to eject the tubular 12, e.g., to make room for the next tubular to take its place, a set of V-shaped kicker plates 16 in the bottom of the pipe trough 14 are actuated by means of a telescoping, two-stage hydraulic cylinder or actuator 18 pinned via pin 18*a* near the middle of the kicker plates 16. When the hydraulic cylinders 18 extend, as shown in FIGS. 2-3, the kicker plates 16 rotate about the pin 17 at the pinned end 19, lifting the tubular 12 out of the pipe trough 14 and rolling it across the platform. When the tubular 12 is fully ejected from the pipe trough 14, the hydraulic cylinders 18 retract and the process repeats with another tubular.

Figure 6:
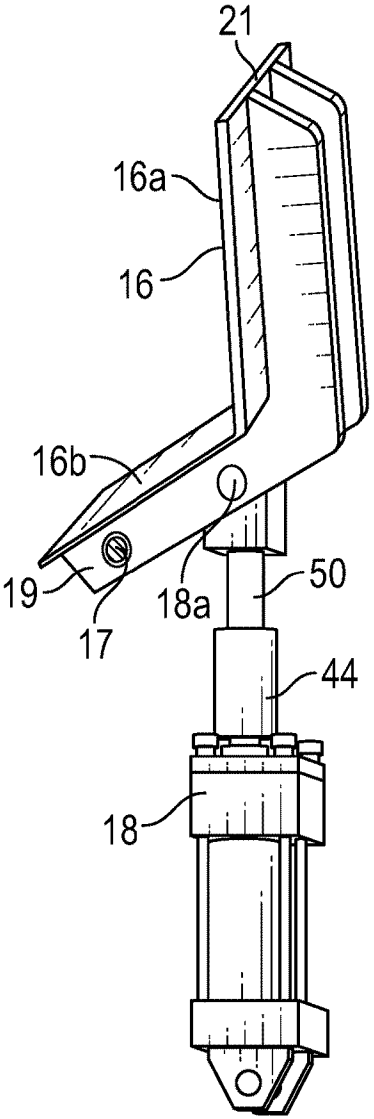
FIG. 6 is a side view of a pipe kicker and actuator in the fully extended second rod stage position according to an embodiment of the present invention.
Figure 5:
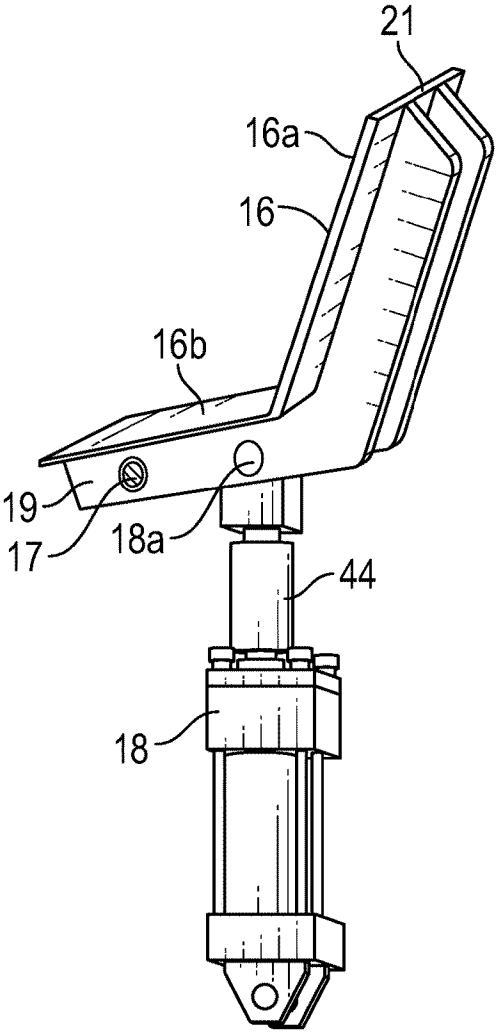
FIG. 5 is a side view of a pipe kicker and actuator in the fully extended first rod stage position according to an embodiment of the present invention.
Figure 4:
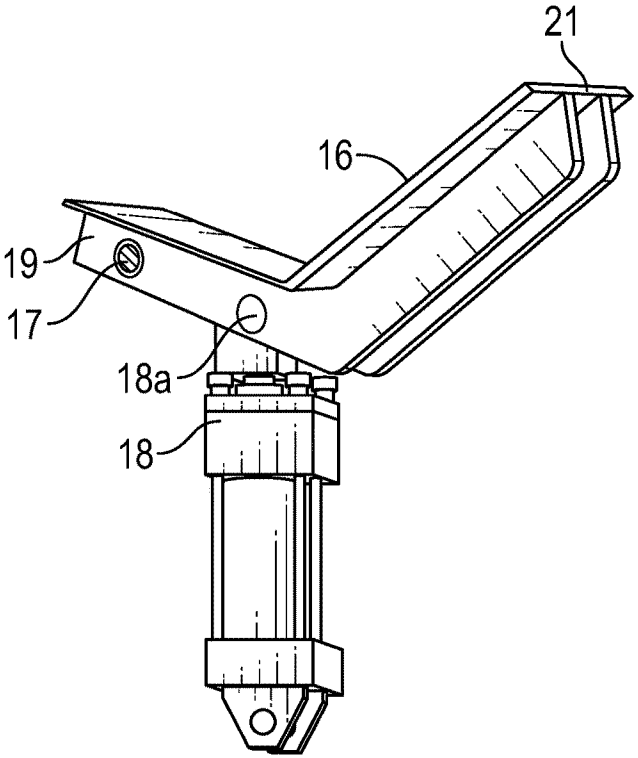
FIG. 4 is a side view of a pipe kicker and actuator in the fully retracted position according to an embodiment of the present invention.

FIGS. 4-6 show side views of the pipe kicker 16 and actuator 18 in various states of operation. In FIG. 4, the actuator 18 is in the fully retracted position and the pipe kicker 16 creates a cradle in the lower part of the vee for the pipe to rest between the free end 21 and pinned end 19. FIG. 5 shows the actuator 18 extending the first stage rod 44 so that the free end portion 16*a* of the vee in the kicker 16 is at an oblique angle to vertical and the pinned end portion 16*b* is at an oblique angle from horizontal sloping slightly downwardly out of the vee, tending to roll the pipe out of the vee. In FIG. 6, both of the first stage rod 44 and the second stage rod 50 are fully extended from the actuator 18. In this configuration, the free end portion 16*a* is vertical or nearly so with the free end 21 rotated above the pinned end 19, and the pinned end portion 16*b* is more acute with respect to horizontal. In any embodiment, the extension of the second stage rod 50 can be faster than the first stage rod 44, tending to "kick" the pipe from the kicker 16.

Figure 7:
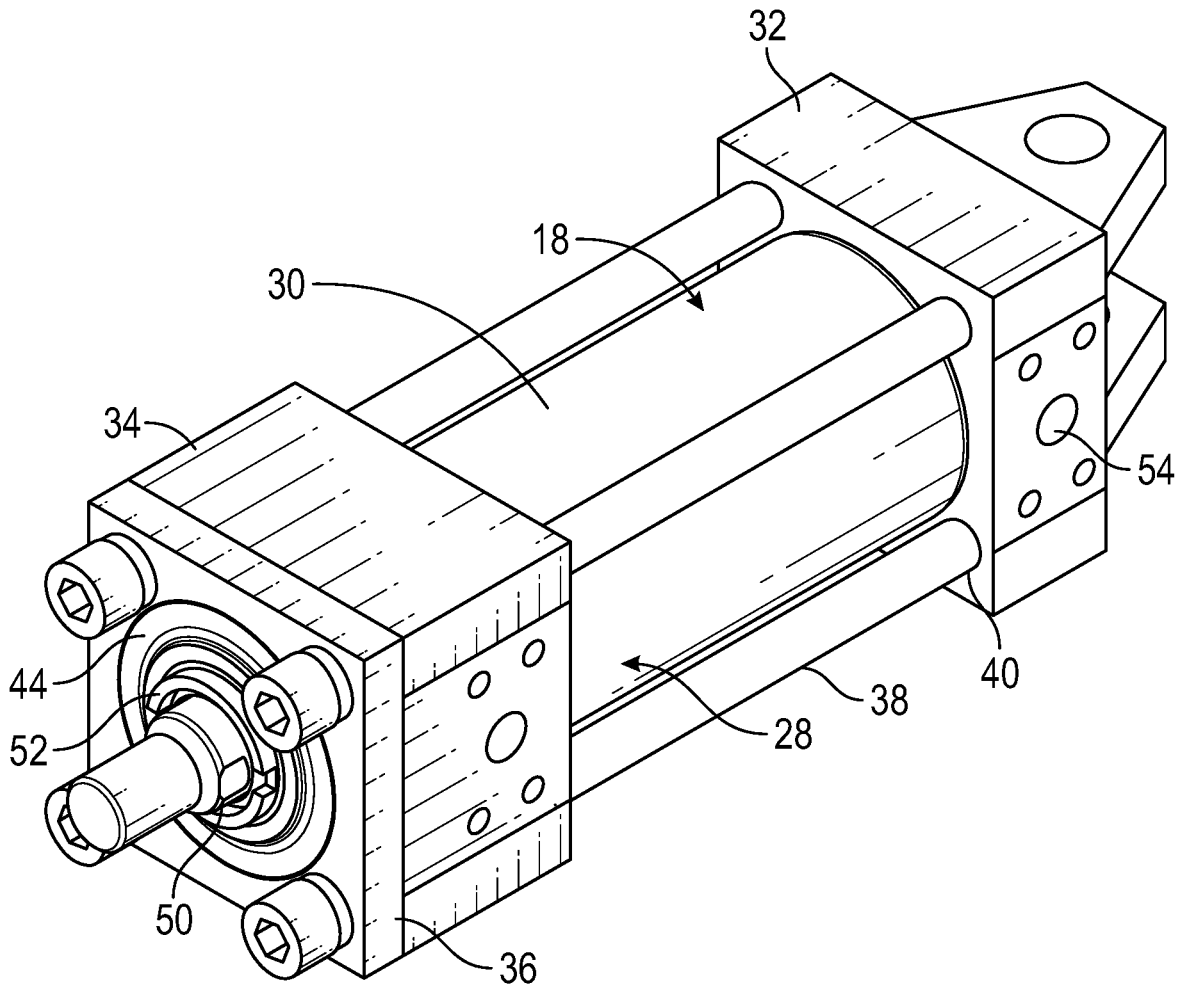
FIG. 7 is a perspective view of an actuator according to an embodiment of the present invention.
Figure 8:
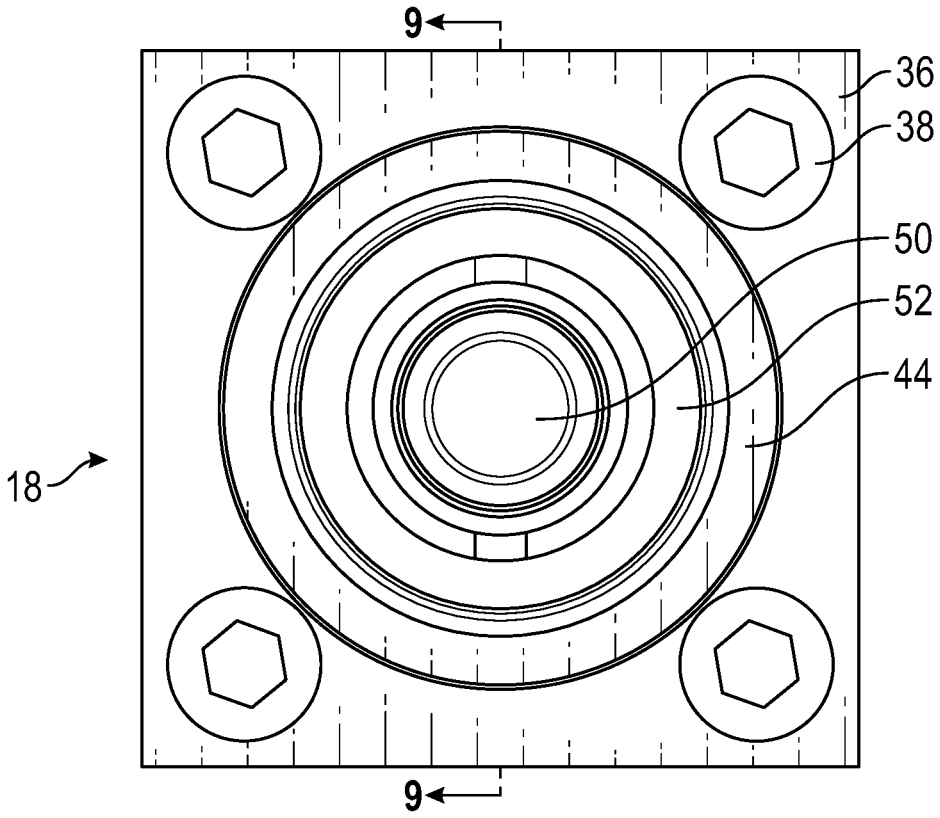
FIG. 8 is an end view of the actuator of FIG. 7.
Figure 9:
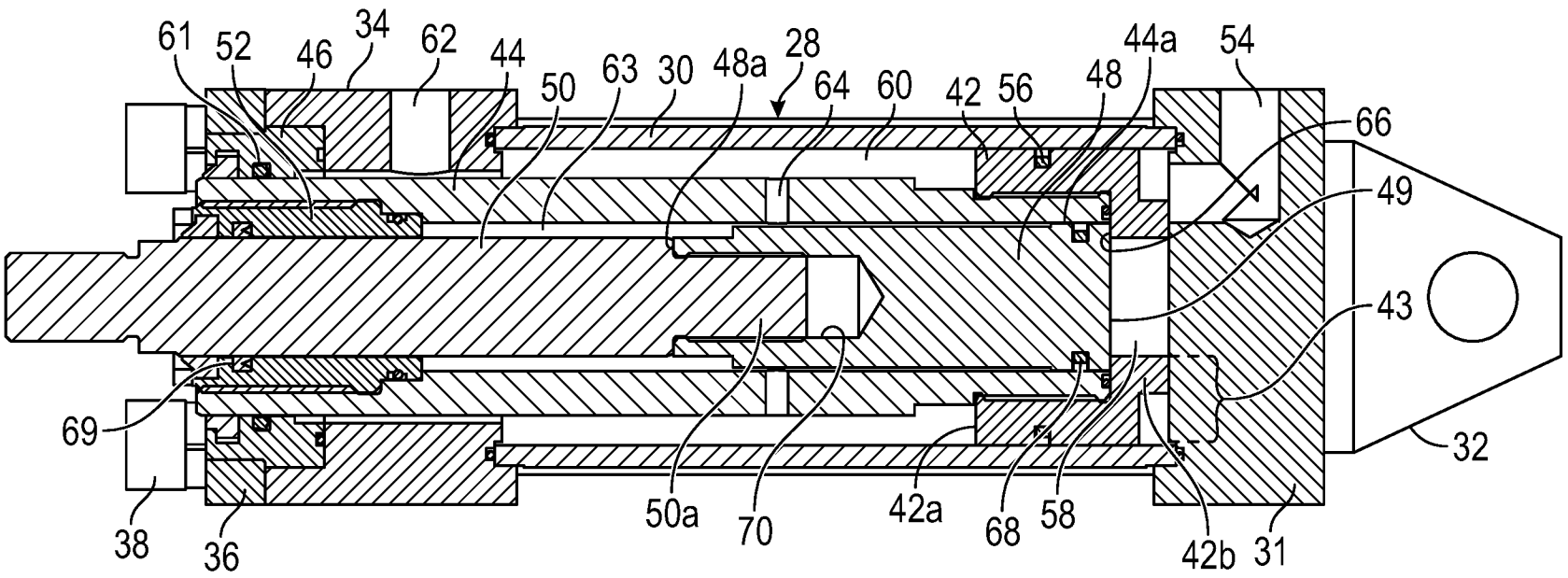
FIG. 9 is a side sectional view of the actuator of FIG. 8 taken along the view lines 9-9.
Figure 10:
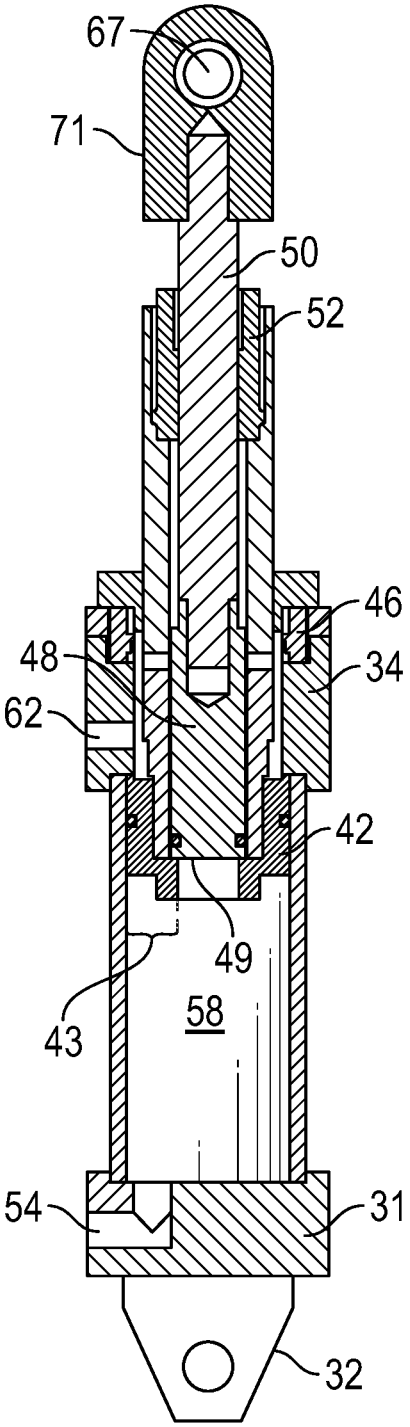
FIG. 10 is a side sectional view of the actuator of FIG. 9 shown with the first stage rod fully extended.
Figure 11:
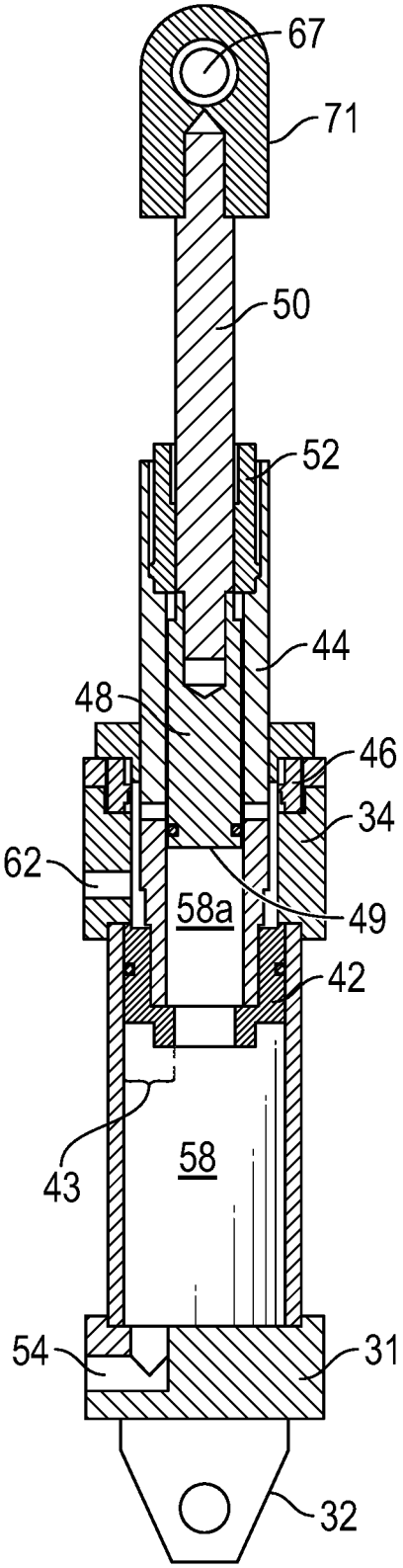
FIG. 11 is a side sectional view of the actuator of FIG. 10 shown with the second stage rod fully extended.

The cylinder 18 is shown in perspective in FIG. 7, in an end view in FIG. 8, and in side sectional views in various stages of operation in FIGS. 9-11. The cylinder 18 is constructed from a housing 28 comprised of a barrel 30, butt plate 31, cap clevis 32, head cap 34, and gland retainer 36, which are secured together by means of cap screws 38 and threaded bores 40 formed in the cap 32. The cylinder 18 houses a first stage piston 42 having a lateral area 43 communicating with the chamber 58, rod 44, and gland 46, and a second stage piston 48 having lateral area 49 communicating with the chamber 58, rod 50, and gland 52.

When hydraulic fluid is introduced via port 54, since lateral area 43 is larger than lateral area 49, initially the first stage piston 42 is slid in the barrel 30. A seal 56 is carried on an outer diameter of the piston 42 to retain the hydraulic fluid in the chamber 58. The gland 46 is situated at the distal end of the annulus 60 and carries a seal 61 on an inside diameter to engage the outside diameter of the first stage rod 44. Fluid in the annulus 60 between the piston 42 and the gland 46 can be bled or withdrawn (or supplied) via port 62 in fluid communication therewith. If desired, the annulus 60 and the annulus 63 between the piston 48 and the gland 52 can be cross-ported at 64. The piston 42 is annularly cup-shaped, having a sleeve portion 42*a* and a flange portion 42*b*. The sleeve portion 42*a* has an inside diameter matching an outside diameter of proximal end 44*a* of the first stage rod 44. If desired, the sleeve portion 42*a* and proximal end 44*a* can be threadedly engaged. The flange portion 42*b* extends inwardly and has an inside diameter which is less than an inside diameter of the first stage rod 44 so as to form a shoulder 66 to serve as a stop for second stage piston 48.

A seal 68 is carried on an outer diameter of the second stage piston 42 to retain hydraulic fluid in the chamber 58. The gland 52 is situated at the distal end of the annulus 61, e.g., threadedly received in the first stage rod 44, and carries a seal 69 on an inside diameter to engage the outside diameter of the second stage rod 50. The piston 48 is generally cylindrical and has a bore 70 formed in distal end 48*a* to receive a proximal end 50*a* of second stage rod 50. If desired, the rod 50 can be threadedly engaged in the bore 70.

In operation, the actuator 18 begins a cycle fully retracted as shown in FIGS. 4 and 9. When hydraulic fluid is supplied to the chamber 58, the first stage piston 42 and rod 44 are slid outwardly as the chamber 58 expands to fully extend the rod 44 until the piston 42 is stopped at the gland 46, as best seen in FIGS. 5 and 10. At the same time, hydraulic fluid is removed from the annulus 60 via port 62. This rotates the kick plate 16 about the pin 67 in the clevis 71 so that the arm 16*b* is at least horizontal, and preferably sloping downward, e.g., at 10-30 degrees. Then, additional hydraulic fluid entering the chamber 58 and the second stage chamber 58*a* begins the extension of the second stage rod 50, and fluid is withdrawn from the annulus 63 via ports 64 and 62. When the second stage piston 48 shoulders against the gland 52, the second stage rod 50 is fully extended, as best seen in FIGS. 6 and 11. This rotates the kick plate 16*a* to approximately vertical, e.g., +/−5 or 10 degrees, and the kick plate 16*b* so that it slopes acutely downwardly, e.g., at an angle equal to or greater than 40 degrees.

Figure 12:
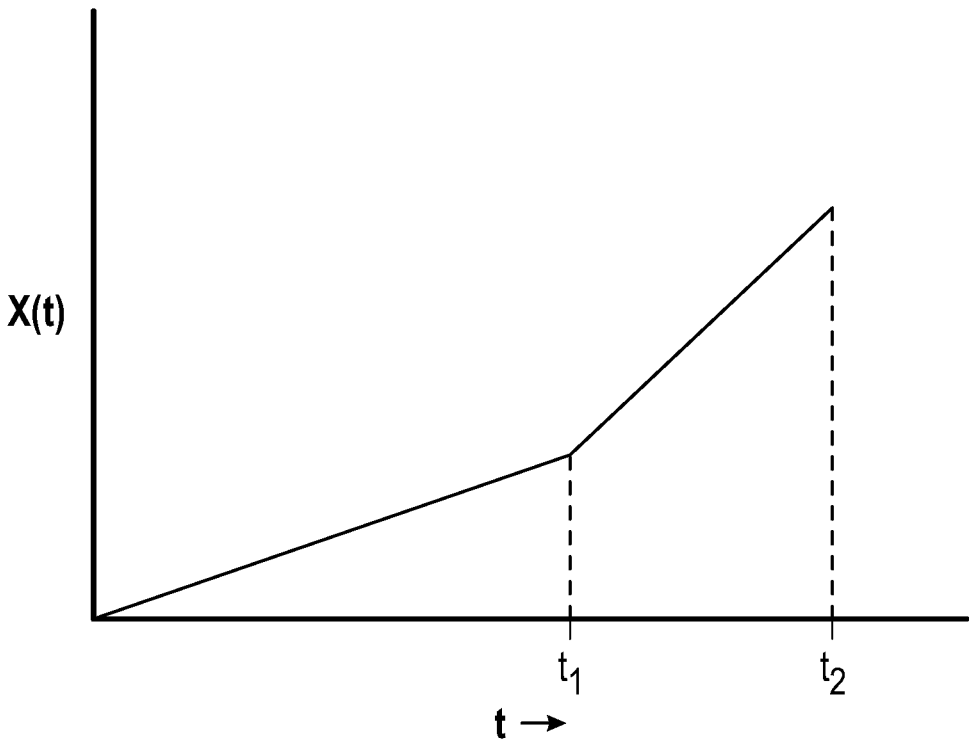
FIG. 12 is a graph of the extension of the actuator as a function of time according to an embodiment of the present invention.

In a preferred embodiment, the length of extension in the first stage is slightly greater than the extension of the second stage, e.g., the first stage can have a bore of 2 inches and a stroke of 4 inches, whereas the second stage can have a 1 inch bore and a stroke of 2.125 inches. In this arrangement the second stage stroke velocity is 4 times faster than the first stage and serves to kick the pipe from the pipe kicker, as shown in FIG. 12. The combination of increased stroke and stroke velocity produces a much more reliable way of ejecting the tubulars from the pipe trough. As a retrofit of existing pipe handling machines, the actuator 18 of the present invention can have the same profile as the existing 2.5-in.×4-in. cylinder, and uses the same hydraulic porting and mechanical attachments.

When it is desired to return the actuator 18 to the starting position, the hydraulic fluid is removed from the chambers 58, 58*a* and supplied to the annulus 60 via port 62. Hydraulic fluid also enters annulus 63 via port 64 to assist retraction of the second stage rod 50. This retracts the first and second stage rods 44, 50.

Embodiments Listing

Accordingly, the invention provides the following embodiments:

1. A pipe-handling tool for use in a catwalk of a drilling rig, comprising:
   - a pipe trough;
   - a V-shaped pipe kicker plate mounted in the pipe trough;
   - the kicker plate comprising a pinned end mounted for rotation about the pin and a free end;
   - an actuator comprising a fixed end attached to a mounting point below the kicker plate and an extendable rod end attached to the kicker plate between the pinned end and the free end;
   - the extendable rod comprising telescopically engaged first and second stages;
   - an annular first stage piston slidably disposed within a housing of the actuator to engage a drive end of the first stage of the rod;
   - a first stage gland slidably receiving the first stage of the rod and disposed at a distal end of a first stage annulus between the housing and the first stage of the rod;
   - a second stage piston slidably disposed within the first stage piston to engage a drive end of the second stage of the rod;
   - a second stage gland slidably receiving the second stage of the rod and disposed at a distal end of a second stage annulus between the first stage rod and the second stage rod; and
   - a source of pressurized fluid to expand a chamber defined by the housing and the first and second stage pistons.

2. The pipe handling tool of Embodiment 1, further comprising a plurality of the V-shaped pipe kicker plates spaced apart along the pipe trough and a like plurality of respective pins and actuators, wherein the respective pins are coaxial.

3. The pipe handling tool of Embodiment 1 or Embodiment 2, wherein a lateral area of the first stage piston communicating with the chamber is larger than a lateral area of the second stage piston communicating with the chamber whereby initially introducing the pressurized fluid into the chamber initially extends the first stage rod.

4. The pipe handling tool of any preceding Embodiment, wherein displacement of the second stage rod per given volume of chamber expansion is greater than displacement of the first stage rod, whereby extension of the second stage rod is faster than extension of the first stage rod at the same rate of supply of the pressurized fluid.

5. The pipe handling tool of any preceding Embodiment, wherein the pressurized fluid comprises hydraulic fluid.

6. The pipe handling tool of any preceding Embodiment, wherein the first stage annulus is ported through the housing and wherein the first annulus and the second stage annulus is cross-ported.

7. The pipe handling tool of any preceding Embodiment, wherein the housing comprises a cylindrical barrel, a head cap at a distal end of the barrel, and a butt plate at a proximal end of the barrel.

8. The pipe handling tool of any preceding Embodiment, wherein the first stage piston is annular and comprises a sleeve portion having an inside diameter engaging (preferably threadedly engaging) an outside diameter of the first stage rod, and a flange portion extending inwardly to provide a stop for the second stage piston.

9. The pipe handling tool of Embodiment 8, further comprising a first piston seal carried on an outside diameter of the first stage piston biased against an inside diameter of the cylinder.

10. The pipe handling tool of Embodiment 8 or Embodiment 9, wherein the sleeve portion of the first piston provides a first shoulder to stop extension of the first rod when the first shoulder abuts the head cap.

11. The pipe handling tool of any preceding Embodiment, wherein the second stage piston is cylindrical and engages (preferably threadedly engages) a proximal end of the second stage rod.

12. The pipe handling tool of Embodiment 11, further comprising a second piston seal carried on an outside diameter of the second stage piston biased against an inside diameter of the first stage rod.

13. The pipe handling tool of Embodiment 11 or Embodiment 12, wherein the second stage gland is carried on an inside diameter at a distal end of the first stage rod, and wherein the second stage piston provides a second shoulder to stop extension of the second rod when the second shoulder abuts the second stage gland.

14. The pipe handling tool of any preceding Embodiment, wherein the actuator is double acting.

15. An actuated kicker plate assembly for use with a pipe-handling tool in a catwalk of a drilling rig, comprising:

a V-shaped pipe kicker plate for mounting in the pipe trough with a pinned end mounted for rotation about the pin and a free end;

an actuator comprising a fixed end for attachment to a mounting point below the kicker plate and an extendable rod end attached to the kicker plate between the pinned end and the free end;

the extendable rod comprising telescopically engaged first and second stages;

an annular first stage piston slidably disposed within a housing of the actuator to engage a drive end of the first stage of the rod;

a first stage gland slidably receiving the first stage of the rod and disposed at a distal end of a first stage annulus between the housing and the first stage of the rod;

a second stage piston slidably disposed within the first stage piston to engage a drive end of the second stage of the rod;

a second stage gland slidably receiving the second stage of the rod and disposed at a distal end of a second stage annulus between the first stage rod and the second stage rod; and a source of hydraulic fluid to expand a chamber defined by the housing and the first and second stage pistons.

16. The actuated kicker plate assembly of Embodiment 15, wherein a lateral area of the first stage piston communicating with the chamber is larger than a lateral area of the second stage piston communicating with the chamber whereby initially introducing the pressurized fluid into the chamber initially extends the first stage rod.

17. The actuated kicker plate assembly of Embodiment 15 or Embodiment 16, wherein displacement of the second stage rod per given volume of chamber expansion is greater than displacement of the first stage rod, whereby extension of the second stage rod is faster than extension of the first stage rod at the same rate of supply of the pressurized fluid.

18. The actuated kicker plate assembly of any of Embodiments 15-17, further comprising:

wherein the first stage annulus is ported through the housing and wherein the first annulus and the second stage annulus is cross-ported; and wherein the housing comprises a cylindrical barrel, a head cap at a distal end of the barrel, and a butt plate at a proximal end of the barrel.

19. The actuated kicker plate assembly of any of Embodiments 15-18, further comprising:

wherein the first stage piston is annular and comprises a sleeve portion having an inside diameter engaging (preferably threadedly engaging) an outside diameter of the first stage rod, and a flange portion extending inwardly to provide a stop for the second stage piston;

a first piston seal carried on an outside diameter of the first stage piston biased against an inside diameter of the cylinder; and wherein the sleeve portion of the first piston provides a first shoulder to stop extension of the first rod when the first shoulder abuts the head cap.

20. The actuated kicker plate assembly of any of Embodiments 15-19, further comprising:

wherein the second stage piston is cylindrical and engages (preferably threadedly engages) a proximal end of the second stage rod;

a second piston seal carried on an outside diameter of the second stage piston biased against an inside diameter of the first stage rod;

wherein the second stage gland is carried on an inside diameter at a distal end of the first stage rod; and wherein the second stage piston provides a second shoulder to stop extension of the second rod when the second shoulder abuts the second stage gland.

21. The actuated kicker plate assembly of any of Embodiments 15-20, wherein the actuator is double acting.

22. A method of handling pipe using the pipe-handling tool of any of Embodiments 1-14, comprising:

placing a tubular in the pipe trough;

supplying the pressurized fluid to expand the chamber and extend the first stage of the rod without extending the second stage of the rod; and then supplying additional pressurized fluid to further expand the chamber and extend the second stage or the rod;

whereby the kicker plate is rotated about the pin and the tubular is ejected from the pipe trough.

23. The method of Embodiment 22, wherein the second stage of the rod is extended at a faster rate than the first stage of the rod is extended.

Although only a few example embodiments have been described in detail above, those skilled in the art will readily appreciate that many modifications are possible in the example embodiments without materially departing from this invention. Accordingly, all such modifications are intended to be included within the scope of this invention as defined in the following claims. It is the express intention of the applicant not to invoke 35 U.S.C. § 112(f) for any limitations of any of the claims herein, except for those in which the claim expressly uses the words 'means for' together with an associated function and without any recitation of structure.

What is claimed is:

1. A pipe-handling tool for use in a catwalk of a drilling rig, comprising:

a pipe trough;

a V-shaped pipe kicker plate mounted in the pipe trough;

the kicker plate comprising a pinned end mounted for rotation about a pin and a free end;

an actuator comprising a fixed end attached to a mounting point below the kicker plate and an extendable rod end attached to the kicker plate between the pinned end and the free end;

the extendable rod comprising telescopically engaged first and second stages;

an annular first stage piston slidably disposed within a housing of the actuator to engage a drive end of the first stage of the rod;

a first stage gland slidably receiving the first stage of the rod and disposed at a distal end of a first stage annulus between the housing and the first stage of the rod;

a second stage piston slidably disposed within the first stage piston to engage a drive end of the second stage of the rod;

a second stage gland slidably receiving the second stage of the rod and disposed at a distal end of a second stage annulus between the first stage rod and the second stage rod; and a source of pressurized fluid to expand a chamber defined by the housing and the first and second stage pistons;

wherein a lateral area of the first stage piston communicating with the chamber is larger than a lateral area of the second stage piston communicating with the chamber and wherein initially introducing the pressurized fluid into the chamber initially extends the first stage rod.

2. The pipe handling tool of claim 1, further comprising a plurality of the V-shaped pipe kicker plates spaced apart along the pipe trough and a like plurality of respective pins and actuators, wherein the respective pins are coaxial.

3. The pipe handling tool of claim 1, wherein displacement of the second stage rod per given volume of chamber expansion is greater than displacement of the first stage rod, whereby extension of the second stage rod is faster than extension of the first stage rod at the same rate of supply of the pressurized fluid.

4. The pipe handling tool of claim 1, wherein the pressurized fluid comprises hydraulic fluid.

5. The pipe handling tool of claim 1, wherein the first stage annulus is ported through the housing and wherein the first stage annulus and the second stage annulus are cross-ported.

6. The pipe handling tool of claim 1, wherein the housing comprises a cylindrical barrel, a head cap at a distal end of the barrel, and a butt plate at a proximal end of the barrel.

7. The pipe handling tool of claim 1, wherein the first stage piston is annular and comprises a sleeve portion having an inside diameter engaging an outside diameter of the first stage rod, and a flange portion extending inwardly to provide a stop for the second stage piston.

8. The pipe handling tool of claim 7, further comprising a first piston seal carried on an outside diameter of the first stage piston biased against an inside diameter of the cylinder.

9. The pipe handling tool of claim 7, wherein the sleeve portion of the first piston provides a first shoulder to stop extension of the first rod when the first shoulder abuts the head cap.

10. The pipe handling tool of claim 1, wherein the second stage piston is cylindrical and engages a proximal end of the second stage rod.

11. The pipe handling tool of claim 10, further comprising a second piston seal carried on an outside diameter of the second stage piston biased against an inside diameter of the first stage rod.

12. The pipe handling tool of claim 10, wherein the second stage gland is carried on an inside diameter at a distal end of the first stage rod, and wherein the second stage piston provides a second shoulder to stop extension of the second rod when the second shoulder abuts the second stage gland.

13. The pipe handling tool of claim 1, wherein the actuator is double acting.

14. A method of handling pipe using the pipe-handling tool of claim 1, comprising:

placing a tubular in the pipe trough;

supplying the pressurized fluid to expand the chamber and extend the first stage of the rod without extending the second stage of the rod; and then supplying additional pressurized fluid to further expand the chamber and extend the second stage or the rod;

wherein the kicker plate is rotated about the pin to rotate a free end portion of the kicker plate to approximately vertical, to rotate a pinned end portion of the kicker plate to slope acutely downward, and to eject the tubular from the pipe trough.

15. The method of claim 14, wherein the second stage of the rod is extended at a faster rate than the first stage of the rod is extended.

16. The pipe handling tool of claim 1, wherein the extendable rod end is rotatably attached to the kicker plate.

17. The pipe handling tool of claim 1, wherein the expansion of the chamber extends the rod to rotate a free end portion of the kicker plate to approximately vertical and rotates a pinned end portion of the kicker plate to slope acutely downward.

18. An actuated kicker plate assembly for use with a pipe-handling tool in a catwalk of a drilling rig, comprising:

a V-shaped pipe kicker plate for mounting in the pipe trough with a pinned end mounted for rotation about a pin and a free end;

an actuator comprising a fixed end for attachment to a mounting point below the kicker plate and an extendable rod end rotatably attached to the kicker plate between the pinned end and the free end;

the extendable rod comprising telescopically engaged first and second stages;

an annular first stage piston slidably disposed within a housing of the actuator to engage a drive end of the first stage of the rod;

a first stage gland slidably receiving the first stage of the rod and disposed at a distal end of a first stage annulus between the housing and the first stage of the rod;

a second stage piston slidably disposed within the first stage piston to engage a drive end of the second stage of the rod;

a second stage gland slidably receiving the second stage of the rod and disposed at a distal end of a second stage annulus between the first stage rod and the second stage rod; and a source of hydraulic fluid to expand a chamber defined by the housing and the first and second stage pistons, extend the rod, rotate a free end portion of the kicker plate to approximately vertical, rotate a pinned end portion of the kicker plate to slope acutely downward, and eject the tubular from the pipe trough;

wherein a lateral area of the first stage piston communicating with the chamber is larger than a lateral area of the second stage piston communicating with the chamber whereby initially introducing the hydraulic fluid into the chamber initially extends the first stage rod.

19. The actuated kicker plate assembly of claim 18, wherein displacement of the second stage rod per given volume of chamber expansion is greater than displacement of the first stage rod, whereby extension of the second stage rod is faster than extension of the first stage rod at the same rate of supply of the pressurized fluid.

20. The actuated kicker plate assembly of claim 18, further comprising:

wherein the first stage annulus is ported through the housing and wherein the first stage annulus and the second stage annulus are cross-ported; and wherein the housing comprises a cylindrical barrel, a head cap at a distal end of the barrel, and a butt plate at a proximal end of the barrel.

21. The actuated kicker plate assembly of claim 18, further comprising:

wherein the first stage piston is annular and comprises a sleeve portion having an inside diameter engaging an outside diameter of the first stage rod, and a flange portion extending inwardly to provide a stop for the second stage piston;

a first piston seal carried on an outside diameter of the first stage piston biased against an inside diameter of the cylinder; and wherein the sleeve portion of the first piston provides a first shoulder to stop extension of the first rod when the first shoulder abuts the head cap.

22. The actuated kicker plate assembly of claim 18, further comprising:

wherein the second stage piston is cylindrical and engages a proximal end of the second stage rod;

a second piston seal carried on an outside diameter of the second stage piston biased against an inside diameter of the first stage rod;

wherein the second stage gland is carried on an inside diameter at a distal end of the first stage rod; and wherein the second stage piston provides a second shoulder to stop extension of the second rod when the second shoulder abuts the second stage gland.

23. The actuated kicker plate assembly of claim 18, wherein the actuator is double acting.

* * * * *